US005878446A

United States Patent [19]

McCann

[11] Patent Number: 5,878,446

[45] Date of Patent: Mar. 9, 1999

[54] WHIRLPOOL JET EXTENSION SYSTEM

[76] Inventor: Daniel J. McCann, 3162 W. 84th, Chicago, Ill. 60652

[21] Appl. No.: 967,422

[22] Filed: Nov. 10, 1997

[51] Int. Cl.[6] ..... E04H 4/00

[52] U.S. Cl. ..... 4/496; 4/568; 4/615; 4/541.6; 239/588

[58] Field of Search ..... 4/488, 492, 494, 4/496, 568, 615, 541.6; 239/588

[56] References Cited

U.S. PATENT DOCUMENTS

| | | | |
|---|---|---|---|
| 3,318,528 | 5/1967 | Williams | 4/496 X |
| 3,776,464 | 12/1973 | Proffit | 492/492 X |
| 4,091,998 | 5/1978 | Peterson | 239/588 X |
| 4,346,484 | 8/1982 | Martin | 4/492 X |
| 4,413,362 | 11/1983 | Chianco et al. | 4/567 |
| 4,458,676 | 7/1984 | Pileggi | 128/53 |
| 5,027,450 | 7/1991 | Lang | 4/542 |
| 5,031,256 | 7/1991 | Mikiya | 4/496 X |
| 5,093,942 | 3/1992 | Lang | 4/542 |

*Primary Examiner*—Charles E. Phillips
*Attorney, Agent, or Firm*—Joseph N. Breaux

[57] ABSTRACT

A whirlpool jet extension system that includes a flexible hose that is connectable to one of the jet nozzles of the whirlpool bath. The flexible hose is easily connected to and detached from one of the jet nozzles of the whirlpool bath and has one or more user positionable suction cup securing assemblies for allowing a user to aim the discharge stream from the flexible hose in a desired direction. In a preferred embodiment the whirlpool jet extension system includes a flexible hose having a first hose end and a second hose end; a least one user positionable suction cup securing assembly slidably positioned on the flexible hose; a rigid tubular handle in connection with the first hose end of the flexible hose; a U-shaped hand grip extending from the rigid tubular handle; a rotatable spray head rotatably mounted to the rigid tubular handle; an internally threaded hose attachment fitting connected to the second hose end of the flexible hose; a jet adapter fitting having a tubular jet nozzle insertion cavity formed into one adapter end thereof and an externally threaded portion companionately threaded for connection with the internally threaded hose attachment fitting; and an internally threaded adapter fitting cover companionately threaded for connection with the externally threaded end portion of the jet adapter fitting.

16 Claims, 2 Drawing Sheets

WHIRLPOOL JET EXTENSION SYSTEM

TECHNICAL FIELD

The present invention relates to whirlpool bath accessories and more particularly to a whirlpool jet extension system that includes a flexible hose having a first hose end and a second hose end; a least one user positionable suction cup securing assembly slidably positioned on the flexible hose; a rigid tubular handle in connection with the first hose end of the flexible hose; a U-shaped hand grip extending from the rigid tubular handle; a rotatable spray head rotatably mounted to the rigid tubular handle; an internally threaded hose attachment fitting connected to the second hose end of the flexible hose; a jet adapter fitting having a tubular jet nozzle insertion cavity formed into one adapter end thereof and an externally threaded portion companionately threaded for connection with the internally threaded hose attachment fitting; and an internally threaded adapter fitting cover companionately threaded for connection with the externally threaded end portion of the jet adapter fitting.

BACKGROUND ART

Whirlpool baths typically have several jet nozzles that each discharge a comforting stream of water and air into a tub cavity within which the bather reclines. Although the comforting streams provide excellent muscle relaxing therapy to those areas upon which the streams are directed, little therapeutic effect is provided to the other areas of the bather's muscles. It would be a benefit, therefore, to have a whirlpool jet extension system that included a flexible hose that was connectable to one of the jet nozzles of the whirlpool bath that allowed a user to direct one of the water and air streams to desired muscle areas. It would also be a benefit to have such a whirlpool jet extension system that included a flexible hose having one or more user positionable suction cup securing assemblies for allowing a user to aim the discharge stream from the flexible hose in a desired direction. Because a bather may not use the whirlpool jet extension system at all times, it would be a further benefit to have a whirlpool jet extension system having a flexible hose that was easily connected and detached as desired.

GENERAL SUMMARY DISCUSSION OF INVENTION

It is thus an object of the invention to provide a whirlpool jet extension system.

It is a further object of the invention to provide a whirlpool jet extension system that includes a flexible hose that is connectable to one of the jet nozzles of the whirlpool bath.

It is a still further object of the invention to provide a whirlpool jet extension system that includes a flexible hose having one or more user positionable suction cup securing assemblies for allowing a user to aim the discharge stream from the flexible hose in a desired direction.

It is a still further object of the invention to provide a whirlpool jet extension system that includes a flexible hose that is easily connected to and detached from one of the jet nozzles of the whirlpool bath as desired.

It is a still further object of the invention to provide a whirlpool jet extension system that includes a flexible hose having a first hose end and a second hose end; a least one user positionable suction cup securing assembly slidably positioned on the flexible hose; a rigid tubular handle in connection with the first hose end of the flexible hose; a U-shaped hand grip extending from the rigid tubular handle; a rotatable spray head rotatably mounted to the rigid tubular handle; an internally threaded hose attachment fitting connected to the second hose end of the flexible hose; a jet adapter fitting having a tubular jet nozzle insertion cavity formed into one adapter end thereof and an externally threaded portion companionately threaded for connection with the internally threaded hose attachment fitting; and an internally threaded adapter fitting cover companionately threaded for connection with the externally threaded end portion of the jet adapter fitting.

It is a still further object of the invention to provide a whirlpool jet extension system that accomplishes some or all of the above objects in combination.

Accordingly, a whirlpool jet extension system is provided. The whirlpool jet extension system includes a flexible hose having a first hose end and a second hose end; a least one user positionable suction cup securing assembly slidably positioned on the flexible hose; a rigid tubular handle in connection with the first hose end of the flexible hose; a U-shaped hand grip extending from the rigid tubular handle; a rotatable spray head rotatably mounted to the rigid tubular handle; an internally threaded hose attachment fitting connected to the second hose end of the flexible hose; a jet adapter fitting having a tubular jet nozzle insertion cavity formed into one adapter end thereof and an externally threaded portion companionately threaded for connection with the internally threaded hose attachment fitting; and an internally threaded adapter fitting cover companionately threaded for connection with the externally threaded end portion of the jet adapter fitting.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
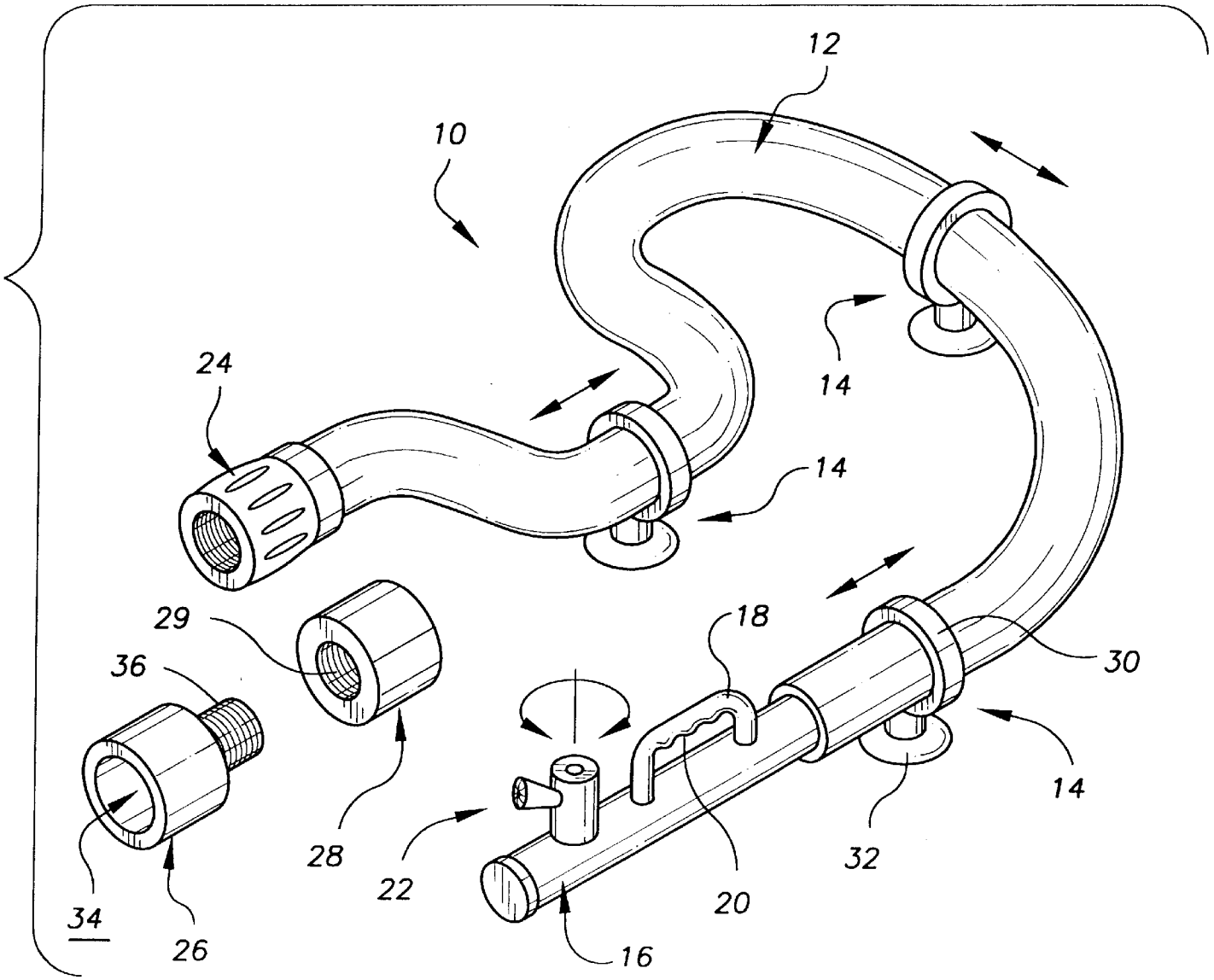
FIG. 1 is a perspective view of an exemplary embodiment of the whirlpool jet extension system of the present invention showing the flexible hose; the three user positionable suction cup securing assemblies; the rigid tubular handle; the U-shaped hand grip; the 360° rotatable spray head; the threaded hose attachment fitting; the jet adapter fitting; and the threaded adapter fitting cover.

FIG. 1 shows an exemplary embodiment of the whirlpool jet extension system of the present invention generally designated by the numeral 10. In this embodiment, whirlpool jet extension system 10 includes a flexible rubber hose, generally designated 12; three user positionable suction cup securing assemblies, generally designated 14; a rigid, stainless steel tubular handle, generally designated 16; a U-shaped hand grip 18 with finger indents 20; a 360° rotatable spray head, generally designated 22; a threaded hose attachment fitting, generally designated 24; a jet adapter fitting, generally designated 26; and a threaded adapter fitting cover, generally designated 28. In this embodiment, flexible rubber hose 12 has a smooth exterior, however, a spring coil type flexible hose and other flexible hoses with non-smooth exterior surfaces can be used to practice the invention taught herein.

User positionable suction cup securing assemblies 14 each include a tubular, plastic, friction ring 30 that is slidably positionable along flexible hose 12 and a conventional rubber suction 32 that is used to provide a suction attachment to the interior of the whirlpool tub for holding flexible hose 12 in a desired position. Threaded hose attachment fitting 24 is a conventional plastic, internally threaded, screw-on female hose connector.

Figure 2:
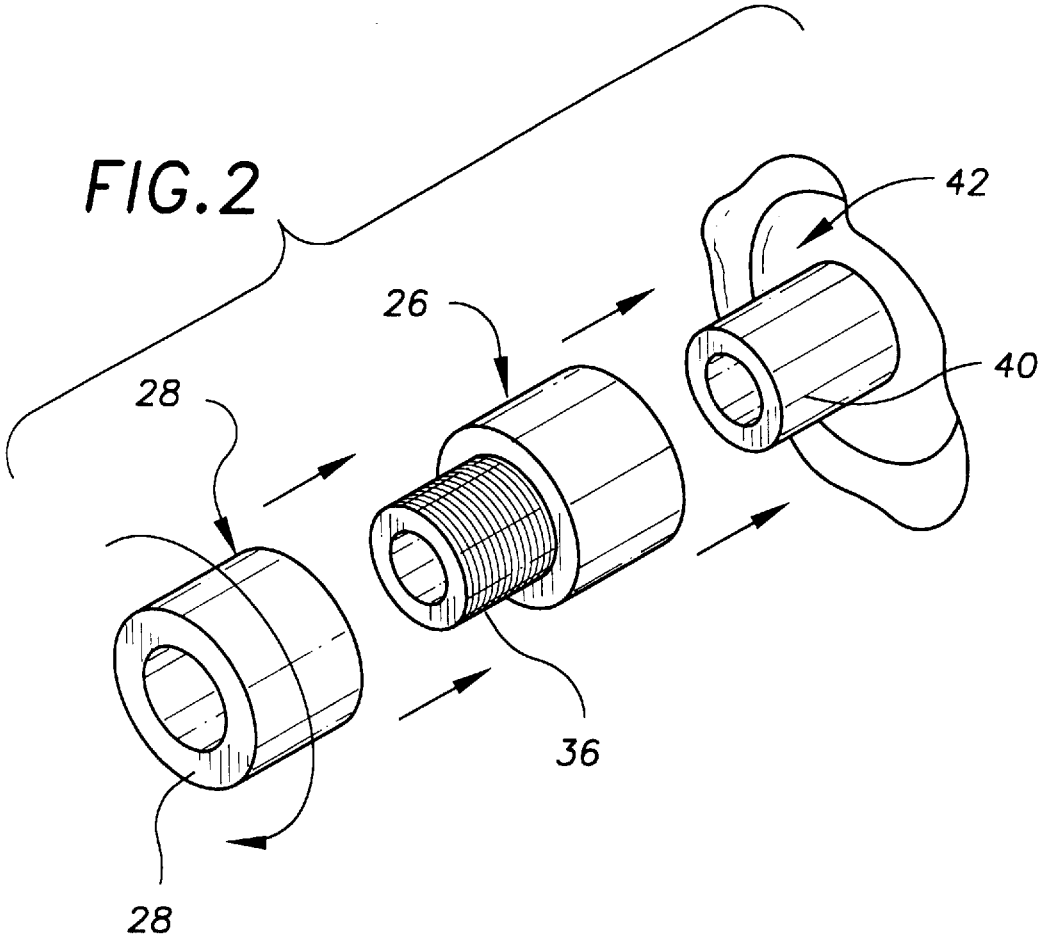
FIG. 2 is an exploded perspective view showing a representative whirlpool jet including a nozzle jet end; the jet adapter fitting with the externally threaded end portion; and the internally threaded adapter fitting cover.
Figure 3:
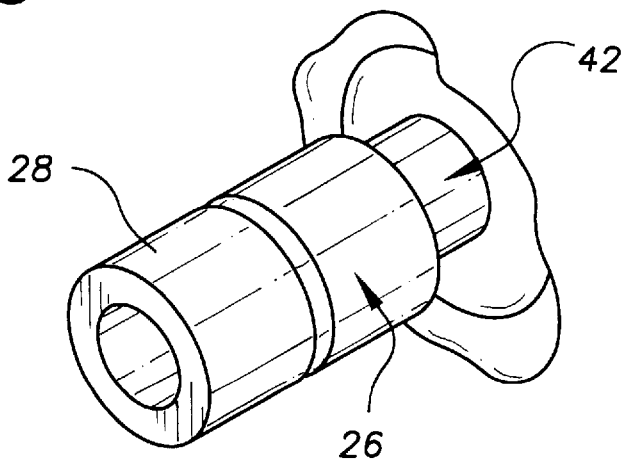
FIG. 3 is a perspective view showing the jet adapter fitting cemented over the nozzle jet end of the whirlpool jet and the internally threaded adapter fitting cover threaded onto the externally threaded end portion of the jet adapter fitting.

Jet adapter fitting 26 and internally threaded adapter fitting cover 28 are of molded plastic construction. Jet adapter fitting 26 includes a tubular jet nozzle insertion cavity 34 formed into one adapter end thereof and an externally threaded portion 36 formed at a second adapter end thereof that is companionately threaded for connection with internally threaded hose attachment fitting 24. Internally threaded adapter fitting cover 28 is companionately threaded 29 for connection with externally threaded portion 36 of jet adapter fitting 26. With reference to FIGS. 2 and 3, during installation a plastic cement or adhesive is applied to the exterior of a nozzle jet end 40 of a representative whirlpool jet 42 and tubular jet nozzle insertion cavity 34 (FIG. 1) of jet adapter fitting 26 is positioned over nozzle jet end 40 to form a permanent attachment. Externally threaded portion 36 of jet adapter fitting 26 is then used to connect threaded hose attachment fitting 24 (FIG. 1) when it is desired to use flexible hose 12 (FIG. 1). When flexible hose 12 (FIG. 1) is not to be used, internally threaded adapter fitting cover 28 is threaded onto externally threaded portion 36 to cover externally threaded portion 36.

It can be seen from the preceding description that a whirlpool jet extension system has been provided that includes a flexible hose that is connectable to one of the jet nozzles of the whirlpool bath; that includes a flexible hose having one or more user positionable suction cup securing assemblies for allowing a user to aim the discharge stream from the flexible hose in a desired direction; that includes a flexible hose that is easily connected to and detached from one of the jet nozzles of the whirlpool bath as desired; and that includes a flexible hose having a first hose end and a second hose end; a least one user positionable suction cup securing assembly slidably positioned on the flexible hose; a rigid tubular handle in connection with the first hose end of the flexible hose; a U-shaped hand grip extending from the rigid tubular handle; a rotatable spray head rotatably mounted to the rigid tubular handle; an internally threaded hose attachment fitting connected to the second hose end of the flexible hose; a jet adapter fitting having a tubular jet nozzle insertion cavity formed into one adapter end thereof and an externally threaded portion companionately threaded for connection with the internally threaded hose attachment fitting; and an internally threaded adapter fitting cover companionately threaded for connection with the externally threaded end portion of the jet adapter fitting.

It is noted that the embodiment of the whirlpool jet extension system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A whirlpool jet extension system comprising:

a flexible hose having a first hose end and a second hose end;

a least one user positionable suction cup securing assembly slidably positioned on said flexible hose;

a rigid tubular handle in connection with said first hose end of said flexible hose;

a rotatable spray head rotatably mounted to said rigid tubular handle;

an internally threaded hose attachment fitting connected to said second hose end of said flexible hose;

a jet adapter fitting having a tubular jet nozzle insertion cavity formed into one adapter end thereof and an externally threaded portion companionately threaded for connection with said internally threaded hose attachment fitting; and an internally threaded adapter fitting cover companionately threaded for connection with said externally threaded end portion of said jet adapter fitting.

2. The whirlpool jet extension system of claim 1, wherein: said rigid tubular handle is constructed of stainless steel.

3. The whirlpool jet extension system of claim 2, further including:

a U-shaped hand grip extending from said rigid tubular handle.

4. The whirlpool jet extension system of claim 3 wherein:

said rotatable spray head rotates three-hundred and sixty degrees.

5. The whirlpool jet extension system of claim 4 wherein:

said jet adapter fitting is constructed of plastic; and said internally threaded adapter fitting cover is constructed of plastic.

6. The whirlpool jet extension system of claim 3 wherein:

said jet adapter fitting is constructed of plastic; and said internally threaded adapter fitting cover is constructed of plastic.

7. The whirlpool jet extension system of claim 2 wherein:

said rotatable spray head rotates three-hundred and sixty degrees.

8. The whirlpool jet extension system of claim 7 wherein:

said jet adapter fitting is constructed of plastic; and said internally threaded adapter fitting cover is constructed of plastic.

9. The whirlpool jet extension system of claim 2 wherein:

said jet adapter fitting is constructed of plastic; and said internally threaded adapter fitting cover is constructed of plastic.

10. The whirlpool jet extension system of claim 1, further including:

a U-shaped hand grip extending from said rigid tubular handle.

11. The whirlpool jet extension system of claim 10 wherein:

said rotatable spray head rotates three-hundred and sixty degrees.

12. The whirlpool jet extension system of claim 11 wherein:

said jet adapter fitting is constructed of plastic; and said internally threaded adapter fitting cover is constructed of plastic.

13. The whirlpool jet extension system of claim 10 wherein:

said jet adapter fitting is constructed of plastic; and said internally threaded adapter fitting cover is constructed of plastic.

14. The whirlpool jet extension system of claim 1 wherein:

said rotatable spray head rotates three-hundred and sixty degrees.

15. The whirlpool jet extension system of claim 14 wherein:

said jet adapter fitting is constructed of plastic; and said internally threaded adapter fitting cover is constructed of plastic.

16. The whirlpool jet extension system of claim 1 wherein:

said jet adapter fitting is constructed of plastic; and said internally threaded adapter fitting cover is constructed of plastic.

* * * * *